United States Patent [19]

Gershenfeld et al.

[11] Patent Number: 4,906,968

[45] Date of Patent: Mar. 6, 1990

[54] PERCOLATING CERMET THIN FILM THERMISTOR

[75] Inventors: Neil Gershenfeld; Watt W. Webb; Jeffrey E. VanCleve, all of Ithaca, N.Y.; Joseph V. Mantese, Washington, Mich.; Eric T. Swartz, Tuscon, Ariz.

[73] Assignee: Cornell Research Foundation, Inc., Ithaca, N.Y.

[21] Appl. No.: 253,027

[22] Filed: Oct. 4, 1988

[51] Int. Cl.[4] ..... H01C 3/34

[52] U.S. Cl. ..... 338/25; 338/308

[58] Field of Search ..... 338/308, 309, 226, 25, 338/22 SD, 22 R; 75/234, 232; 419/10, 35

[56] References Cited

U.S. PATENT DOCUMENTS

| | | | |
|---|---|---|---|
| 4,100,524 | 7/1978 | Kirsch | 338/308 X |
| 4,104,421 | 8/1978 | Maher et al. | 338/308 X |
| 4,104,607 | 8/1978 | Jones | 338/309 |
| 4,183,746 | 1/1980 | Pearce et al. | 75/234 |
| 4,280,114 | 7/1981 | Del Vecchio et al. | 338/226 X |
| 4,398,169 | 8/1983 | Hayashi | 338/25 |
| 4,454,495 | 6/1984 | Werner et al. | 338/22 R X |
| 4,526,785 | 7/1985 | Trotter, Jr. | 428/209 |
| 4,609,903 | 9/1986 | Toyokura et al. | 338/22 SD |

*Primary Examiner*—Clifford C. Shaw
*Assistant Examiner*—M. M. Lateef
*Attorney, Agent, or Firm*—Sughrue, Mion, Zinn, Macpeak & Seas

[57] ABSTRACT

A cermet thin film resistor having small particles of a refractory metal embedded in a ceramic insulator at compositions near the percolation transition. The cermets are produced by co-deposition in a dual-electron beam evaporator. The refractory metal is typically Mo or Pt. The insulator is typically a $Al_2O_3$, although other insulators, for example $SiO_2$ may be used. Deposition occurs onto a suitable substrate such as a sapphire under an oxygen environment, typically $10^{-5}$ Torr $O_2$ with the stage heated in the range of typically 400° C. Such is done to increase the size of the metallic regions. The microstructure is 10–50 Å embedded metal in the ceramic. The resulting films are in the range of 1500 Å thick which provides a film having a typical resistivity of 400 mΩ - cm which may then be patterned using lithography techniques to form two or four terminal resistors.

20 Claims, 4 Drawing Sheets

PERCOLATING CERMET THIN FILM THERMISTOR

This invention was made under a grant from the National Science Foundation, DMR 84-14796.

BACKGROUND OF THE INVENTION

This invention relates to mixtures of ceramic materials and metals known as cermets and in particular, to a cermet thin-film resistor used in thermometry.

Mixtures of ceramics and metals may possess properties which are not manifest in either individual constituent. Such mixtures known as cermets are described, for example in U.S. Pat. No. 4,183,746. As set forth in that patent, one type of cermet, platinum-alumina, was identified as electrically conducting having potential utilization as a high temperature thermometer. Cermets are also reviewed in Abeles, Appl. Solid States Sci. 6,1, (1976).

In order to have a useful thermometer, the device must often meet stringent and conflicting requirements. The device should be easy to use, sensitive over a wide temperature range, stable, small, and have a low heat capacity and additionally have a weak magnetic field dependence. Most probes used for low temperature thermometry are either not monotonic in temperature, diverge faster than a power law or saturate at a limiting value. Thus, their working temperature range is limited. To date, while cermets have been the subject of exploration for a variety of different utilizations, the definition of a satisfactory cermet thermistor has not been achieved.

SUMMARY OF THE INVENTION

It is therefore an object of this invention to provide for a cermet thin-film resistor having continuous sensitivity over a wide temperature range.

Yet another object of this invention is to provide a method of making a cermet thin film thermistor having adjustable temperature dependence and excellent stability.

Yet another object of this invention is to define a thin film cermet thermistor having a weak saturable magnetoresistance.

In particular, in accordance with this invention, a cermet thin film resistor comprises small particles of a refractory metal (e.g. Pt or Mo) embedded in a ceramic insulator near the percolation transition (e.g. approximately 60 volume percent metal). At the percolation transition the resistance is independant of temperature; as the metallic fraction decreases the thermometry element becomes more sensitive. Compositions in the range of 45–50% metal volume percent are well suited for general thermometry. In accordance with this invention, the cermets are produced by co-deposition in a dual-electron beam evaporator. The refractory metal is typically Mo or Pt. The insulator is typically $Al_2O_3$ although $SiO_2$ may be used. Deposition occurs onto a suitable substrate such as a sapphire under an oxygen environment, typically $10^{-5}$ Torr $O_2$ with the stage heated in the range of typically 400° C. Such is done to increase the size of the metallic regions. The microstructure is 10–50Å of metal embedded in the bulk insulator. The resulting films are in the range of 1,500Å thick which provides a film having a typical resistivity of 40 mΩ–cm which may then be patterned using lithography techniques to form two or four terminal resistors.

This invention will be described in greater detail by referring to the description of the preferred embodiment and the drawings which are attached.

DESCRIPTION OF THE PREFERRED EMBODIMENT

Figure 1:
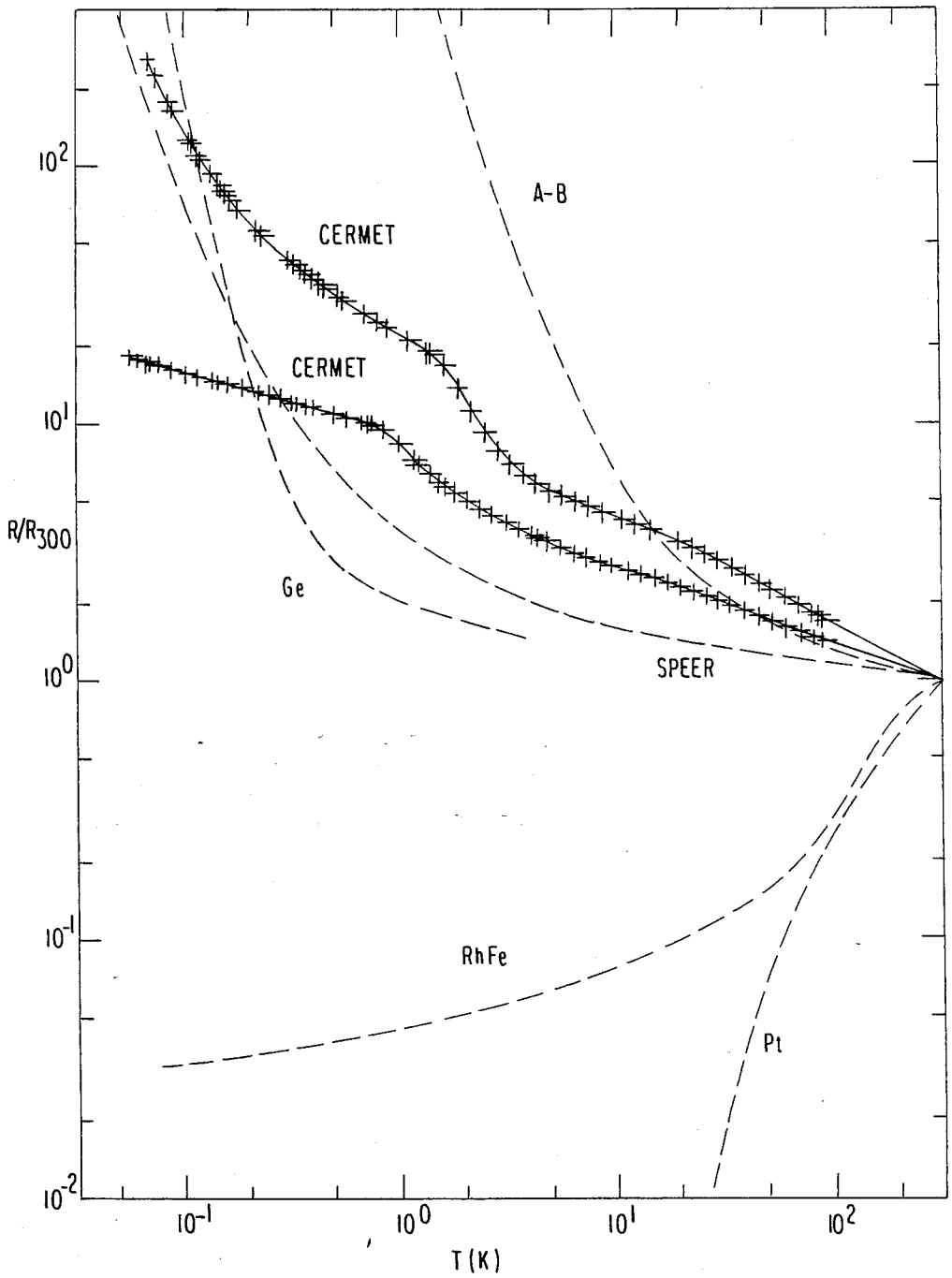
FIG. 1 is a graph plotting resistance versus temperature for two cermets made in accordance with this invention and other known thermometers.

As reported in the literature, a useful thermometer having a wide temperature range must be stable, small, have a low heat capacity and a weak magnetic field dependence. This invention utilizes a ceramic-metal composite or cermet thin film having unique transport properties near the percolation transition which offer a number of advantages over existing technologies for use in secondary thermometry. The cermets are produced by co-deposition utilizing a dual-electron-beam evaporator. It will be appreciated that other deposition techniques such as sputtering or CVD may be employed. The materials are refractory metals such as Pt or Mo and a ceramic insulator such as $Al_2O_3$. Deposition occurs on a sapphire substrate. It will be appreciated that other substrates may be used. For example, silicon and various glasses may be used. The deposition is done in a chamber with a base pressure of $10^{-9}$ Torr; $10^{-5}$ Torr of $O_2$ being added to insure that the $Al_2O_3$ grows stochiometrically. The sample stage is heated to 400° C. to increase the size of the metallic regions and promote particle mobility. The useful composition for thermometers, as defined by the crystal monitors during deposition and confirmed by Rutherford back scattering and electron micro-probe analysis, is in the range of 45–50 volume percent metal. Variations in the metal volume are within the scope of this invention to vary sensitivity. In accordance with this invention the typical deposition rates are 4Å/sec Pt, and 5Å/sec $Al_2O_3$. The resulting films are in the range of 1,500Å in thickness. This provides a film having resistivity of approximately 40 mΩ-cm. The film may be lithographically patterned to form resistors having either two or four terminals.

The micro structure of these films has been determined by TEM. They consist of Pt regions approximately 10–50Å large embodied in bulk $Al_2O_3$. As the Pt fraction is decreased, the system passes through a percolation transition where the continuous metallic pathway disappears and thermally assisted tunneling or hopping becomes the dominant conduction mechanism. This conduction phenomena is described in Mantese, et al, *Phys. Rev. Lett.*, 55:2212 (1985); Mantese, et al, *Phys. Rev. B.*, 33:7897 (1986) and Bertier, et al, *Thin Solid Films*, 125:171 (1985).

When cooled, the resistance of most materials will either fall to a limiting value or rise exponentially depending on its metallic character. The useful thermometry properties of cermets arise due to the distribution of grain sizes and spacings below the percolation transition which leads to a temperature dependence of the resistance that increases monotonically with decreasing temperature. This temperature dependence grows slower than the exponential rate characteristic of thermally activated processes with a single characteristic energy.

No specific theory has been advanced which accounts for the transport properties of such materials. Applicable concepts include the thermal hopping and tunneling between metallic regions, quantum size effects, the charging energies of the metallic regions, conduction within larger clusters, and defect states in the insulator. It is believed that no simple theory can fully incorporate all of those aspects. However, the literature has defined a number of attempts to include gross features. References made to Sheng et al, *Phys. Rev. B.*, 27:2583 (1983); Entin-Wohlman et al, *J. Phys. C.*, 16:1161 (1983) and Adkins, *J. Phys. C.*, 20:235 (1987). As set forth in those reports, the theories differ in detail. However, all agree that the temperature dependence of the resistance should be of the form $$R = R_0 \exp\left(\frac{T_0}{T}\right)^{\alpha} \quad (1)$$

where $\alpha$ is in the range of 0.5–0.25 and may have a crossover from a high temperature to a low temperature limit.

Referring to FIG. 1, a graph of resistance versus temperature for two cermets made in accordance with this invention and a number of standard resistance thermometers is plotted. The cermets of this invention are Pt-$Al_2O_3$. Both have a composition in the range of 45–50% metal volume % Pt in $Al_2O_3$ and are 1,500Å thick. The difference between the two arises from variations in the metallic fraction over the deposition area. As illustrated, the cermets are sensitive over the entire temperature range. That is, as illustrated in FIG. 1 an important aspect of the cermets of this invention is that they are sensitive over a temperature span of 50 mK–300 K. The nominal slopes of the two curves on a log-log plot are approximately $\frac{1}{3}$ and $\frac{2}{3}$ and they are a function of the Pt fraction.

In accordance with this invention cermets made of Mo in place of Pt.will behave similarly above the onset of super conductivity at 1.1 K. The transition temperature for bulk Mo is 0.92 K.

FIG. 1 compares such data with known thermometers. References made to "Techniques and Condensed Matter Physics at Low Temperature", Richardson and Smith (Addison-Wesley, Boston, 1988) for such data. Thus, FIG. 1 plots the temperature dependence of the resistance of 220Ω Speer, RhFe, Ge, Allen-Bradley (A-B), and Pt thermometers using the data and sources contained in Richardson et al, supra.

Figure 2:
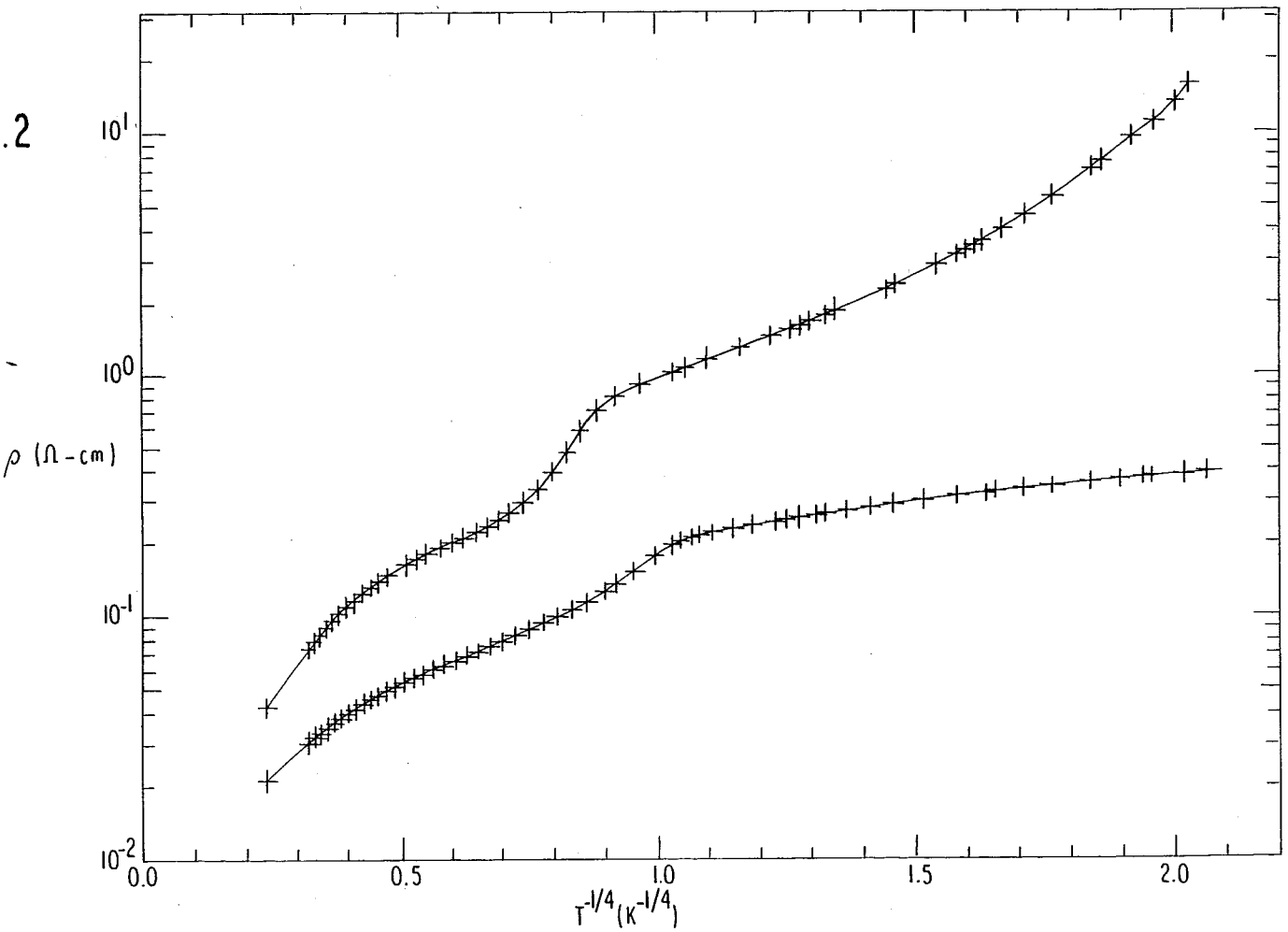
FIG. 2 is a curve of the logarithm of resistance versus $T^{-\frac{1}{4}}$ *for two cermets made in accordance with this invention*.

Referring now to FIG. 2 this cermet data from FIG. 1 has been replotted as a function of $T^{-\frac{1}{4}}$. *This plot has been done in order to determine the temperature dependence of resistance as a function of equation* (1). The data presented in FIG. 2 extends the measured temperature range by two decades beyond that reported in the literature (see McAlister, et al, *Phys. Rev. B.*, 31:5113 (1985); Affinito, et al, *J. Vac. Sci. Technol.*, 2:316 (1984); and Hill et al, *Thin Solid Films*, 89:207 (1982)).

As indicated in FIG. 2, four distinct temperature regimes are distinguishable for all measurements. None of the regimes spans a large enough temperature range to reliably extract a single value for $\alpha$. Existing theories may be employed to explain the functional form within one or two of these regions. However, the inventors believe that the additional transitions which are observed cannot be adequately explained by existing theory.

Figure 3:
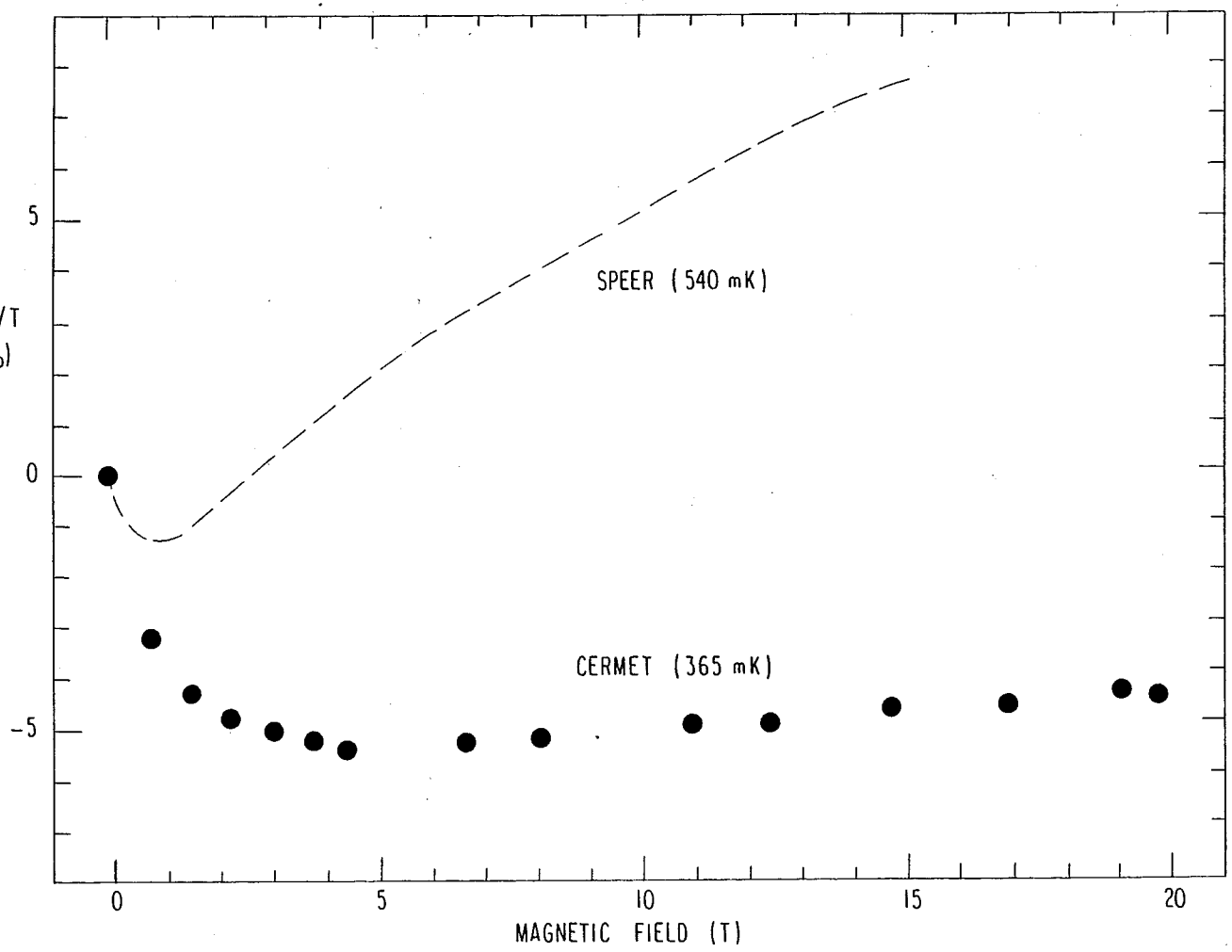
FIG. 3 is a graph of magnetoresistance for a cermet made in accordance with this invention with a prior art resistor plotted as a function of fractional effective temperature error due to applied field.

Referring to FIG. 3 of the magnetoresistance of a 45% Pt-$Al_2O_3$ cermet in accordance with this invention and a prior art 220Ω Speer carbon thermometer are compared. For further data concerning such a plot, references made to Gershenfeld, Proc. of the 18th Int. Con. on Low Tem. Phy., J. Jap. Jour of App. Phys., Supp. 26-3:1741 (1987). The resistance has been scaled by the temperature dependence to show the effective change in the indicated temperature. That is, $\Delta R/R$ for the cermet has been divided by 0.38 and for the Speer thermometer by 0.33 (see Richardson et al, supra). For the cermet film, there is a weak field dependence to the effect of temperature change at low fields, which quickly saturates and remains constant to within 2% out to 20 T. This field independence may be explained by the weak coupling to the field of thermally assisted hopping. This field insensitivity is important for thermometry in high fields.

Figure 4:
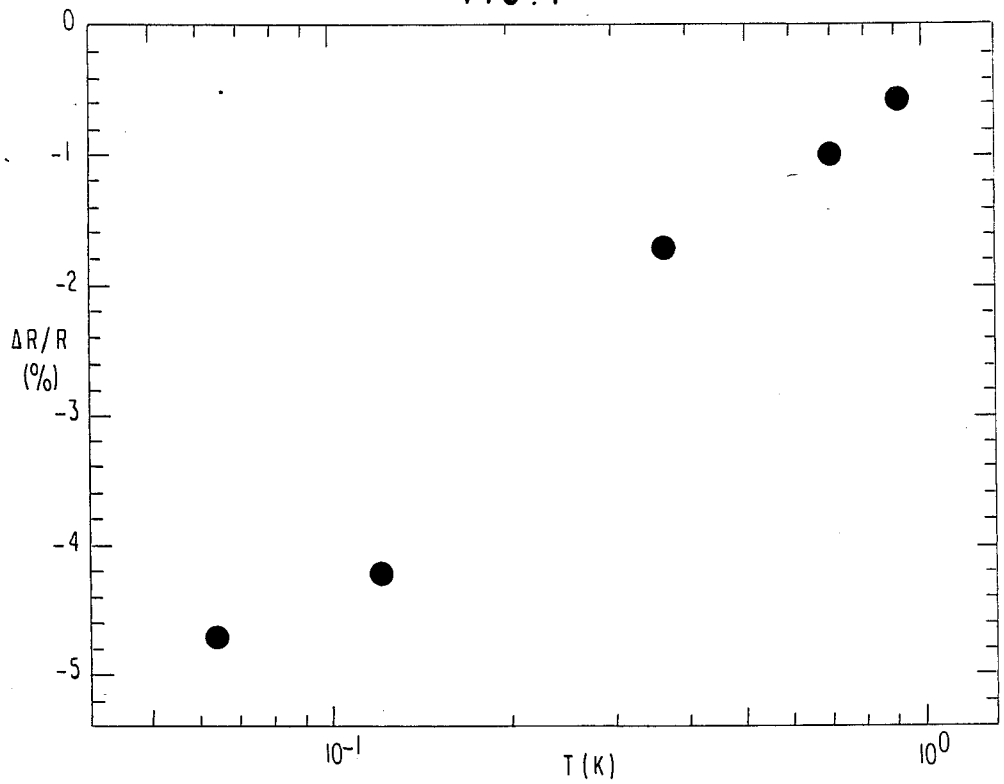
FIG. 4 is a graph of the percent fractional change in resistance between 0 and 20 Tesla of a cermet made in accordance with this invention as a function of temperature.

As the temperature is increased, the shape of the magneto resistance curve remains approximately the same and the saturation value decreases, becoming less than 1% at 1 K. Such dependence is illustrated in FIG. 4 which plots the fractional change in resistance of a 45% Pt-$Al_2O_3$ cermet between 0 Tesla and 20 Tesla as a function of temperature. FIG. 4 illustrates the decrease in field sensitivity as temperature increases. This small magnetic field dependence of the materials makes them useful for thermometry in high fields.

As indicated herein, thermometers of this type are quite robust because they consist of Pt, a refractory metal which does not form an oxide, embedded in a $Al_2O_3$ matrix on a single crystal sapphire substrate. To test resiliency of cermet thermometers in accordance with this invention, thermocycling was effectuated. Samples were repeatedly cooled to 4.2 K and then warmed to 300 K. The observed variations in the resistance correspond to a temperature excursion of roughly 1 mk. This is in the range of temperature fluctuations in the helium storage dewar which was used for measurement. Long-term resistance drifts of a thermometer mounted in a cryostat were less than 0.1% over a period of months.

The properties of these thermometers depend on their proximity to a percolation transition and are quite sensitive to details of fabrication. It is preferred that the ratio of resistance at 300 K to that at 4.2 K (the RRR) be used to screen thermometers. Variations of a factor of five in the RRR between devices made during a single deposition and those from similar depositions have been observed. This may be attributed to spatial or temporal variations in the relative deposition rates of the metal and the insulator. Co-sputtering will improve control over the cermet properties (see Bertier et al, supra) and therefore have better control of the thermometer parameters.

Reference is made to Bosch et al, *Cryogenics,* 86:3 (1986) to compare cermet thermometers related to thick-film $RuO_2$–$Al_2O_3$ composite thermometers. Such thermometers have a temperature dependence as defined in the equation above. The cermet thermometers of this invention offer the advantages of a weak saturable magnetoresistance since the magnetoresistance of $RuO_2$ resistors has a complicated form which may change sign with increasing temperature or field (see Li, et al, *Cryogenics,* 26:467 (1986). Additionally, the cermet thermometers of this invention exhibit no specific heat anomalies while the $RuO_2$ thermometers demonstrate anomalies around 0.5 K (see Love et al, *Rev. Sci. Inst.,* 58:113 (1987).

Additionally, the cermet thermometer of this invention provides for easy integration with conventional thin-film processing. Due to the fact that the films of this invention are so resistive, useful resistances can be obtained from micron-size thermometers. Moreover, because these thermometers are thin films, the heat capacity of the thermometer is dominated by its packaging. To minimize the heat capacity of size, the films can be directly deposited onto the experimental device. The measurements reported herein indicate that Pt and Mo-$Al_2O_3$ cermets near the percolation transition possess many useful properties for low temperature thermometers.

Figure 5:
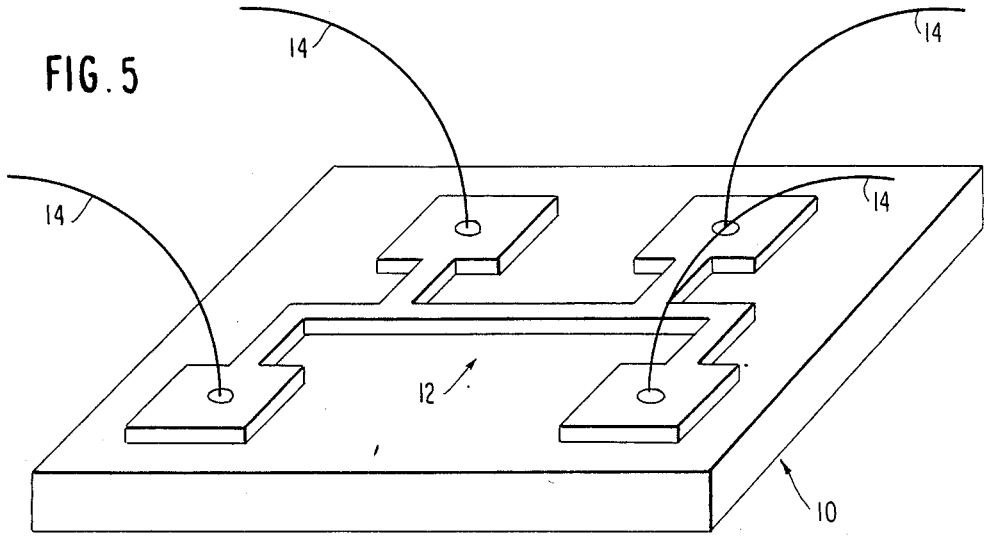
FIG. 5 is a side view of an element made in accordance with this invention.

The resulting element is illustrated in FIG. 5. The substrate 10 is typically sapphire 10 mils thick. The cermet 12 is a thin film in the range of 1500 Å Mo, Pt and $Al_2O_3$ processed in a manner set forth herein. Four leads 14 are illustrated patterned on the device. The device can be made in accordance with established thin film technology and appropriately patterned.

It is apparent that modifications of this invention may be made without departing from the essential scope thereof.

Having described our invention, we claim:

1. A thermometry element comprising:

an oxide substrate, and a thin cermet film deposited on said substrate and having the formula M-C where M is a refractory metal and C is a ceramic insulator processed just below the percolation transition, said cermet having 45–50% metal volume.

2. The element of claim 1, wherein the metal is Pt.

3. The element of claim 1, wherein the metal is Mo.

4. The element of claim 1, wherein the ceramic insulator is sapphire.

5. The element of claim 1, wherein said thin cermet film has a thickness approximately 1,500 Å.

6. The element of claim 1, wherein said cermet comprises a metallic particle size in the range of 10–50 Å embedded in said ceramic insulator.

7. The element of claim 1, wherein said thin film is patterned and further comprises at least a pair of terminals.

8. The element of claim 1, wherein said oxide substrate is a single crystal sapphire.

9. The element of claim 1, wherein said substrate is $SiO_2$.

10. The element of claim 1, wherein said element has a temperature sensitive range of 50 mk–300 mk.

11. A temperature sensitive resistor comprising; an oxide substrate, and a thin film cermet made from a refractory metal-ceramic mixture deposited on said substrate and processed to just below the percolation transition, said cermet having 45–50 metal volume.

12. The element of claim 11, wherein the metal is Pt.

13. The element of claim 11, wherein the metal is Mo.

14. The element of claim 11, wherein the ceramic is sapphire.

15. The element of claim 11, wherein said thin cermet film has a thickness approximately 1,500 Å.

16. The element of claim 11, wherein said cermet having a particle size in the range of 10–50 Å metal embedded in said ceramic.

17. The element of claim 11, wherein said thin film is patterned and further comprises at least a pair of terminals.

18. The element of claim 11, wherein said oxide substrate is a single crystal sapphire.

19. The element of claim 11, wherein said substrate is $SiO_2$.

20. The element of claim 11, wherein said element has a temperature sensitive range of 50 mk–300 mk.

* * * * *